US012000150B2

(12) United States Patent
McMillan et al.

(10) Patent No.: US 12,000,150 B2
(45) Date of Patent: Jun. 4, 2024

(54) DROP-IN ROLLBAR FOR USE IN AWNING SYSTEM

(71) Applicant: Carefree/Scott Fetzer Company, Broomfield, CO (US)

(72) Inventors: David Thomas McMillan, Louisville, CO (US); Travis Styron Titus, Superior, CO (US); Peter Adamkovics, Arvada, CO (US); Gregory Keith Heimbuck, Arvada, CO (US)

(73) Assignee: Carefree/Scott Fetzer Company, Broomfield, CO (US)

( * ) Notice: Subject to any disclaimer, the term of this patent is extended or adjusted under 35 U.S.C. 154(b) by 722 days.

(21) Appl. No.: 17/006,379

(22) Filed: Aug. 28, 2020

(65) Prior Publication Data

US 2021/0062515 A1 Mar. 4, 2021

Related U.S. Application Data

(60) Provisional application No. 62/892,971, filed on Aug. 28, 2019.

(51) Int. Cl.
*E04F 10/06* (2006.01)

(52) U.S. Cl.
CPC ..... *E04F 10/0633* (2013.01); *E04F 10/0618* (2013.01); *E04F 10/0648* (2013.01); *E04F 10/0685* (2013.01)

(58) Field of Classification Search
CPC ..... E04F 10/0618; E04F 10/0648; E04F 10/0688; E06B 9/72; E06B 9/50
See application file for complete search history.

(56) References Cited

U.S. PATENT DOCUMENTS 2,580,776 A * 1/1952 Herman ..... E06B 9/54 160/23.1
3,722,571 A * 3/1973 Knight ..... E04F 10/0662 135/904
4,171,013 A * 10/1979 Clark ..... E04F 10/0614 135/904
4,399,855 A * 8/1983 Volfson ..... E06B 9/11 160/271
6,196,508 B1 * 3/2001 Nijs ..... A47H 1/13 248/267

(Continued)

*Primary Examiner* — Abe Massad
(74) *Attorney, Agent, or Firm* — Watts Law LLC; Samantha R. Smart, Esq.

(57) ABSTRACT

A lateral arm assembly and method of operation includes a lateral arm awning assembly comprising a box cassette supporting a roll bar, A first end cap having a first end cap portion and a second end cap portion, the first end cap portion coupled to a first box end of the box cassette and the second end cap portion coupled to a first bar end of the roll bar, the second end cap portion removably couplable to the first end cap portion, and a second end cap coupled to a second box end of the box cassette, the first box end opposite the second box end, the second end cap spaced from the first end cap by the box cassette, the second end cap having a third end cap portion and a fourth end cap portion, the third end cap portion coupled to the second box end and the fourth end cap portion coupled to a second bar end of the roll bar, the first bar end opposite the second bar end, the fourth end cap portion removably couplable to the third end cap portion.

20 Claims, 12 Drawing Sheets

(56) References Cited

U.S. PATENT DOCUMENTS

| | | | | |
|---|---|---|---|---|
| 6,263,942 | B1 * | 7/2001 | Miller | E06B 9/58 160/133 |
| 9,347,261 | B2 * | 5/2016 | Blair | E06B 9/42 |
| 10,316,522 | B2 | 6/2019 | Thompson et al. | |
| 2009/0127369 | A1 * | 5/2009 | Mullet | E06B 9/56 242/379 |
| 2012/0160975 | A1 * | 6/2012 | Cannaverde | A47H 1/14 248/208 |
| 2014/0262061 | A1 * | 9/2014 | Stawski | E04F 10/0662 160/66 |
| 2018/0023340 | A1 * | 1/2018 | Goldberg | E06B 9/50 160/324 |
| 2018/0163465 | A1 * | 6/2018 | Biedermann | E06B 9/72 |
| 2019/0162021 | A1 * | 5/2019 | De Vries | E06B 9/60 |
| 2019/0301166 | A1 * | 10/2019 | Thompson | E04F 10/0651 |

* cited by examiner (PRIOR ART)

DROP-IN ROLLBAR FOR USE IN AWNING SYSTEM

CROSS REFERENCES TO RELATED APPLICATIONS

The following application claims priority under 35 U.S.C. 119(e) to U.S. Provisional Patent Application Ser. No. 62/892,971 filed Aug. 28, 2019 entitled DROP-IN ROLLBAR FOR USE IN AWNING SYSTEM. The above-identified application from which priority is claimed is incorporated herein by reference in its entirety for all purposes.

TECHNICAL FIELD

The present disclosure relates to a drop-in rollbar for use in an awning system and method of removing and attaching the drop-in rollbar into the awning system, and more specifically, a retractable cassette or box awning having a two-piece end plate for facilitating attaching and removing the drop-in rollbar.

BACKGROUND

Many retractable awning systems, for example, are mounted on the sides of motor homes or over patios or windows. These awning systems have a fabric canopy that is typically rolled or furled around a roller tube/rollbar when not in use. The awnings have retraction systems that are actuated by a motor, a spring, or a manually operated gearbox to retract the awning. The roller tube may be connected to extension arms (or other extension structures) to extend and contract the arms while the roller tube is rotated by systems mentioned. The motor, spring, or manually operated gearbox is typically connected to the roller tube to rotate it in clockwise and/or counterclockwise directions, thus operating to furl or unfurl the canopy around or from the roller tube.

Lateral arm awnings have lateral arms that articulate from a folded position against the sidewall of the motor home to an extended position in the same plane or near same plane that supports the extended canopy. The roller tube and motor are mounted against the wall of the motor home, or stationary wall, typically within a box or other housing. A lead rail is mounted to the distal ends of each of the lateral arms and a leading edge of the canopy is attached along the length of the lead rail. The lead rail is typically lightweight and does not need to resist significant tension or compression due to a vertical load because the edge of the canopy is lightweight. Further, installation is not impeded by structures on the sidewall of the motor home because the awning can be installed well above any windows or other structures. However, changing out the rollbar or motor, once mounted, can be onerous.

As illustrated in prior art FIGS. 1 and 2, awning systems 10 typically include one or more side-by-side awning cassettes/boxes 10*a*, 10*b*, that include rollbars 14 coupled to one or more end plates 12 and at least partially housed within an awning body 22. The end plates 12, which need to be accessed to disconnect a rollbar 14 and/or a motor 16, are relatively close to each other (e.g., between 1 to 3 inches). A connection mechanism 20 is typically inserted vertically (VERT) through the end plate 12 to secure the rollbar 14 and/or the motor 16 to the end plate. The location of the connection mechanism 20 makes it difficult to remove the rollbar 14 and/or the motor 16 without removing the entire awning cassette 10. Further, the rollbar 14 is supported solely by the connection mechanism 20 being coupled to the end plate 12, meaning the rollbar will shift or slide after being detached from a first end plate 12*a* while a user is attempting to remove the rollbar from a second end plate 12*b*. This shift or slide can apply torque to the still connected end plate 12, causing deformation of the end plate and/or the connection mechanism 20.

The information included in this Background section of the specification, including any references cited herein and any description or discussion thereof, is included for technical reference purposes only and is not to be regarded subject matter by which the scope of the disclosure or claims is to be bound.

SUMMARY

One example embodiment of the present disclosure comprises a lateral arm awning assembly comprising a box cassette supporting a roll bar. A first end cap having a first end cap portion and a second end cap portion, the first end cap portion coupled to a first box end of the box cassette and the second end cap portion coupled to a first bar end of the roll bar, the second end cap portion removably couplable to the first end cap portion, and a second end cap coupled to a second box end of the box cassette, the first box end opposite the second box end, the second end cap spaced from the first end cap by the box cassette, the second end cap having a third end cap portion and a fourth end cap portion, the third end cap portion coupled to the second box end and the fourth end cap portion coupled to a second bar end of the roll bar, the first bar end opposite the second bar end, the fourth end cap portion removably couplable to the third end cap portion.

Another example embodiment of the present disclosure comprises a method of assembling a lateral arm awning assembly comprising inserting a second end cap portion into a complementary u-shaped channel of a first end cap portion to form a first end cap, the first end cap portion coupled to a first box end of a box cassette and the second end cap portion coupled to a first bar end of a roll bar, the second end cap portion removably couplable to the first end cap portion. The method further including inserting a fourth end cap portion into a complementary u-shaped channel of a third end cap portion to form a second end cap, the second end cap coupled to a second box end of the box cassette, the first box end opposite the second box end, the second end cap spaced from the first end cap by the box cassette, the fourth end cap portion removably couplable to the third end cap portion, a box cassette supporting a roll bar, and inserting connectors into respective first and second through holes of the second and fourth end cap portions which align with respective first and second connector areas of the first and fourth end cap portions.

Yet another example embodiment of the present disclosure comprises a lateral arm awning assembly comprising a roll bar coupled to a motor, a box cassette supporting the roll bar, a first end cap having a first end cap portion and a second end cap portion, the first end cap portion coupled to a first box end of the box cassette and the second end cap portion coupled to a first bar end of the roll bar, the second end cap portion removably couplable to the first end cap portion, the first end cap portion defining a u-shaped channel complementary to the second end cap portion and first and second connection areas, the second end cap portion having first and second connection wings respectively defining first and second through holes, the first and second through holes being concentrically aligned with the first and second connection areas, the first and second through holes and the first and second connection areas defining an opening that extends towards the box cassette, and a second end cap coupled to a second box end of the box cassette, the first box end opposite the second box end, the second end cap spaced from the first end cap by the box cassette, the second end cap having a third end cap portion and a fourth end cap portion, the third end cap portion coupled to the second box end and the fourth end cap portion coupled to a second bar end of the roll bar, the first bar end opposite the second bar end, the fourth end cap portion removably couplable to the third end cap portion wherein the first end cap comprises a mirror image of the second end cap.

BRIEF DESCRIPTION OF THE DRAWINGS

The foregoing and other features and advantages of the present disclosure will become apparent to one skilled in the art to which the present invention relates upon consideration of the following description of the invention with reference to the accompanying drawings, wherein like reference numerals refer to like parts unless described otherwise throughout the drawings and in which.

Figures 1, 2:
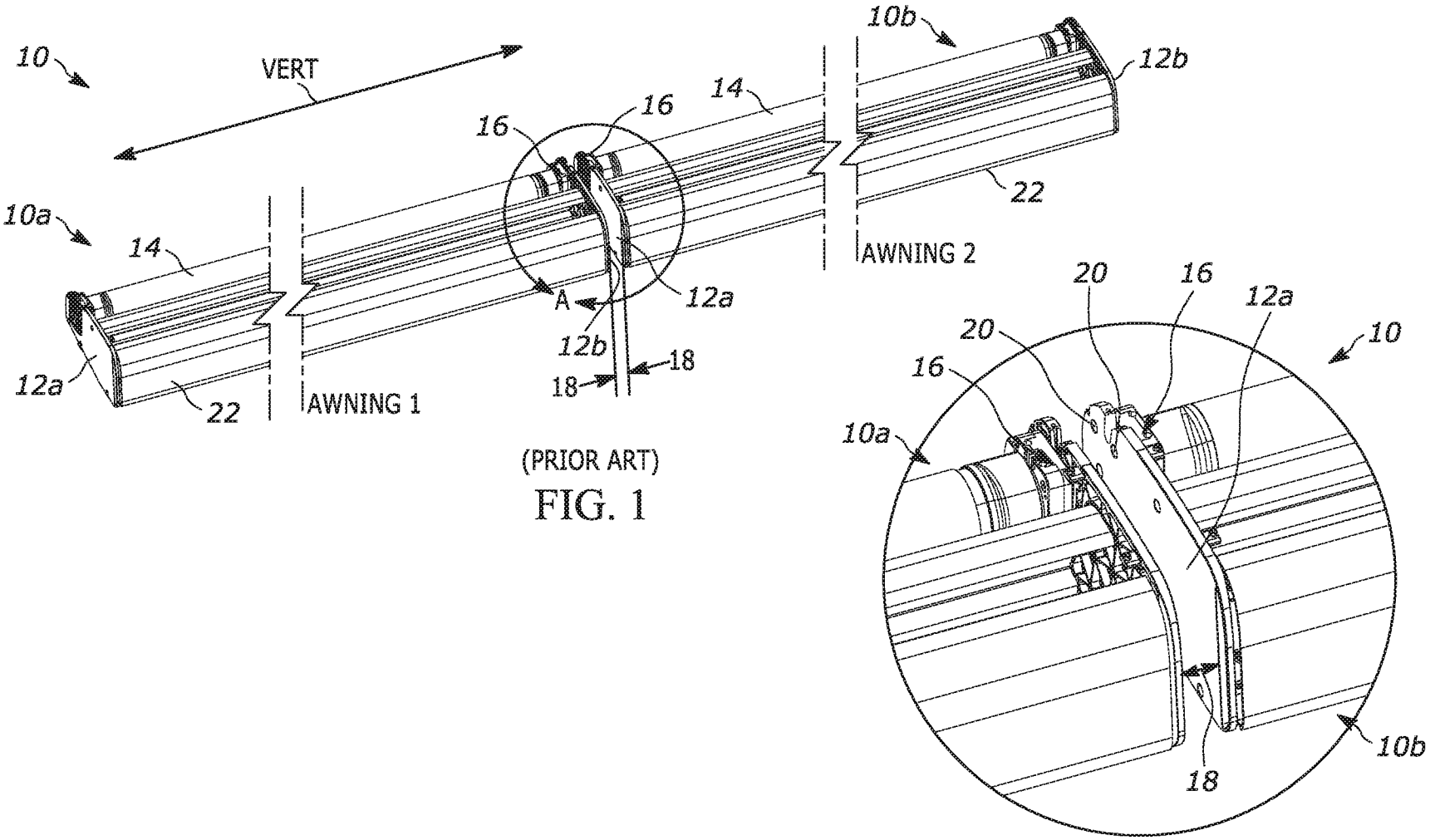
FIG. 1 (PRIOR ART)
FIG. 1 is a left bottom view of a prior art lateral arm awning assembly having laterally spaced awnings cassettes or boxes in a retracted position with respective roller tubes and motors mounted to single piece end plates.
FIG. 2 is a magnified view of FIG. 1 taken in circle A.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

The apparatus and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Referring now to the figures generally wherein like numbered features shown therein refer to like elements throughout unless otherwise noted. The present disclosure relates to a drop-in rollbar for use in an awning system and method of removing and attaching the drop-in rollbar into an awning system, and more specifically, a retractable cassette or box awning having a two-piece end plate for facilitating attaching and removing the drop-in rollbar.

Figure 3A:
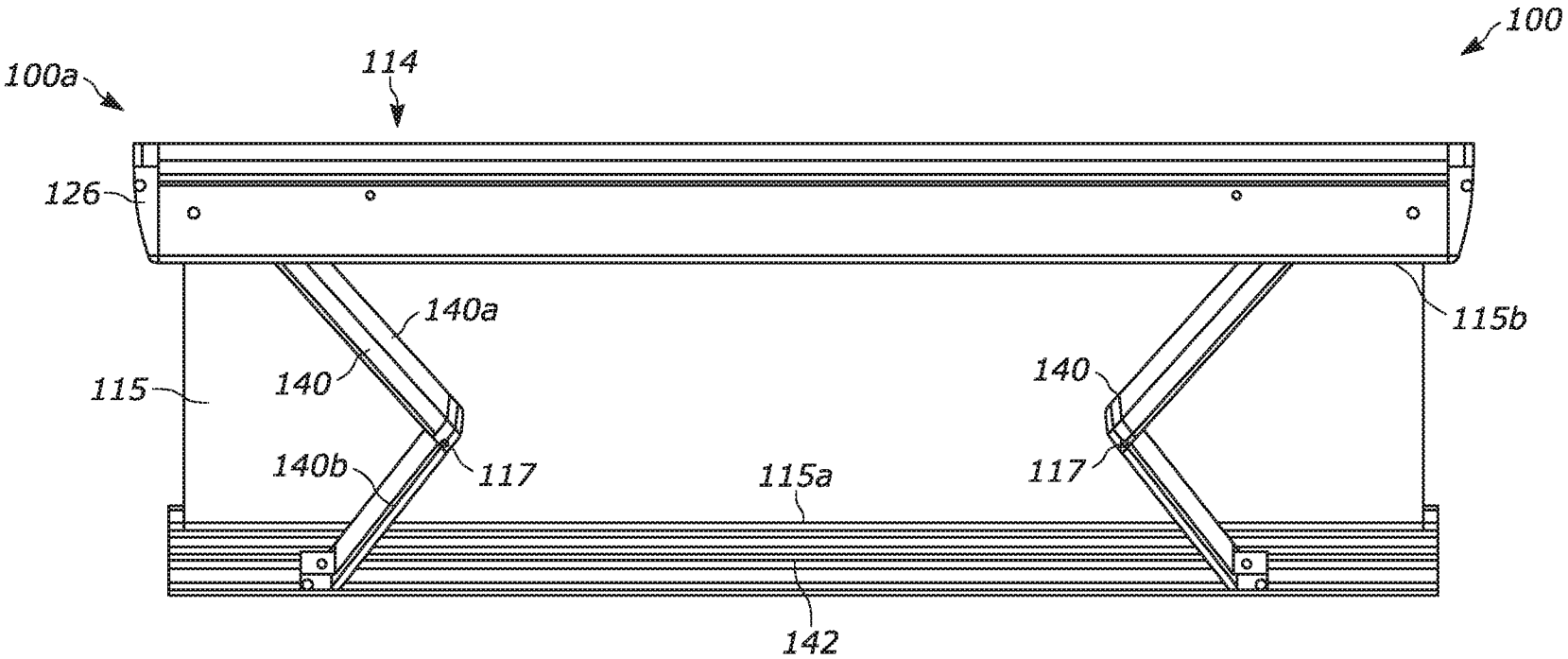
FIG. 3A is a rear bottom view of a lateral arm awning assembly having an extended canopy, in accordance with one example embodiment of the present disclosure.
Figures 3, 4:
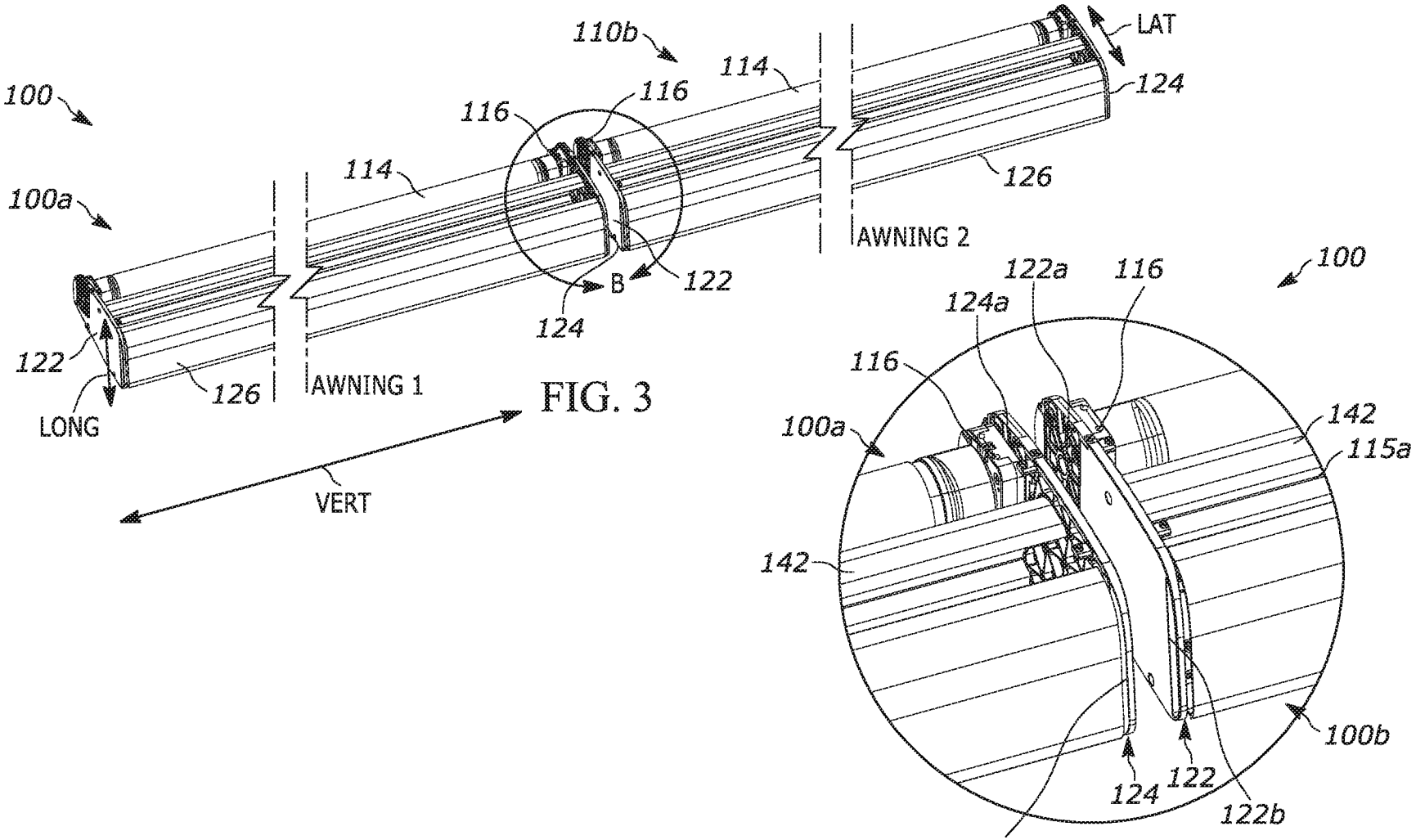
FIG. 3 is a left bottom view of a lateral arm awning assembly having laterally spaced awning cassettes or boxes in a retracted position with respective roll bars and motors mounted to respective first pieces of two-piece end plates in accordance with one example embodiment of the present disclosure.
FIG. 4 is a magnified view of FIG. 3 taken in circle B.

An illustrated example embodiment of a lateral arm awning assembly 100 is illustrated in FIGS. 3A-4. The lateral arm awning assembly 100 comprises one or more laterally spaced lateral arm awnings 100*a*, 100*b* comprising one of boxes or cassettes. Each lateral arm awning 100*a*, 100*b* comprises first and second end caps 122, 124 laterally spaced from each other by their respective awning bodies 126.

As illustrated in the example embodiment of FIG. 3A, the lateral arm awning 100*a* has first and second lateral arms 140 that extend away from the awning body 126. The first and second lateral arms 140 support a lead rail 142, the lead rail is coupled to a first end 115*a* of a canopy 115. The canopy 115 is attached to a rollbar 114 (see FIG. 3) at a second end 115*b* of the canopy. The canopy 115 is unfurled responsive to the lead rail 142 being extended away from the awning body 126, and furled responsive to the lead rail being retracted toward the awning body. Typically, the first and second lateral arms 140 are housed within the awning body 126 when the canopy is furled. In one example embodiment, such as illustrated in FIGS. 3-4, a motor 116 is coupled to the rollbar 114 and actuates the canopy 115 from at least one of the furled position to the unfurled position and/or the unfurled position to the furled position. In another example embodiment, an actuator (e.g., a spring, hydraulic, electric, etc.) is coupled to the first and second lateral arms 140 to facilitate or oppose furling and/or unfurling of the canopy 115.

As illustrated in the example embodiment of FIG. 3A, the first and second lateral arms 140 are, respectively, composed of a proximal arm 140*a* and a distal arm 140*b* pivotally joined together at an arm elbow 117, such a configuration is disclosed in U.S. Pat. No. 10,316,522, assigned to Carefree a Scott Fetzer Co., and incorporated herein by reference in its entirety and for all purposes. The proximal and distal arms 140*a*, 140*b* rotate with respect to each other at the arm elbows 117 such that each proximal arm is closer to being axially aligned with its respective distal arm rather than each set of proximal and distal arms being substantially parallel and adjacent to each other when the awning is in the stowed position. The first and second lateral arms 140 may fold together to be stowed with the rollbar 114 and the furled canopy 115 against the wall or other mounting surface. In one example embodiment, a front cap (not shown) encapsulates/covers the rollbar 114 while defining an opening through which the first and second lateral arm 140 extend.

Figure 5:
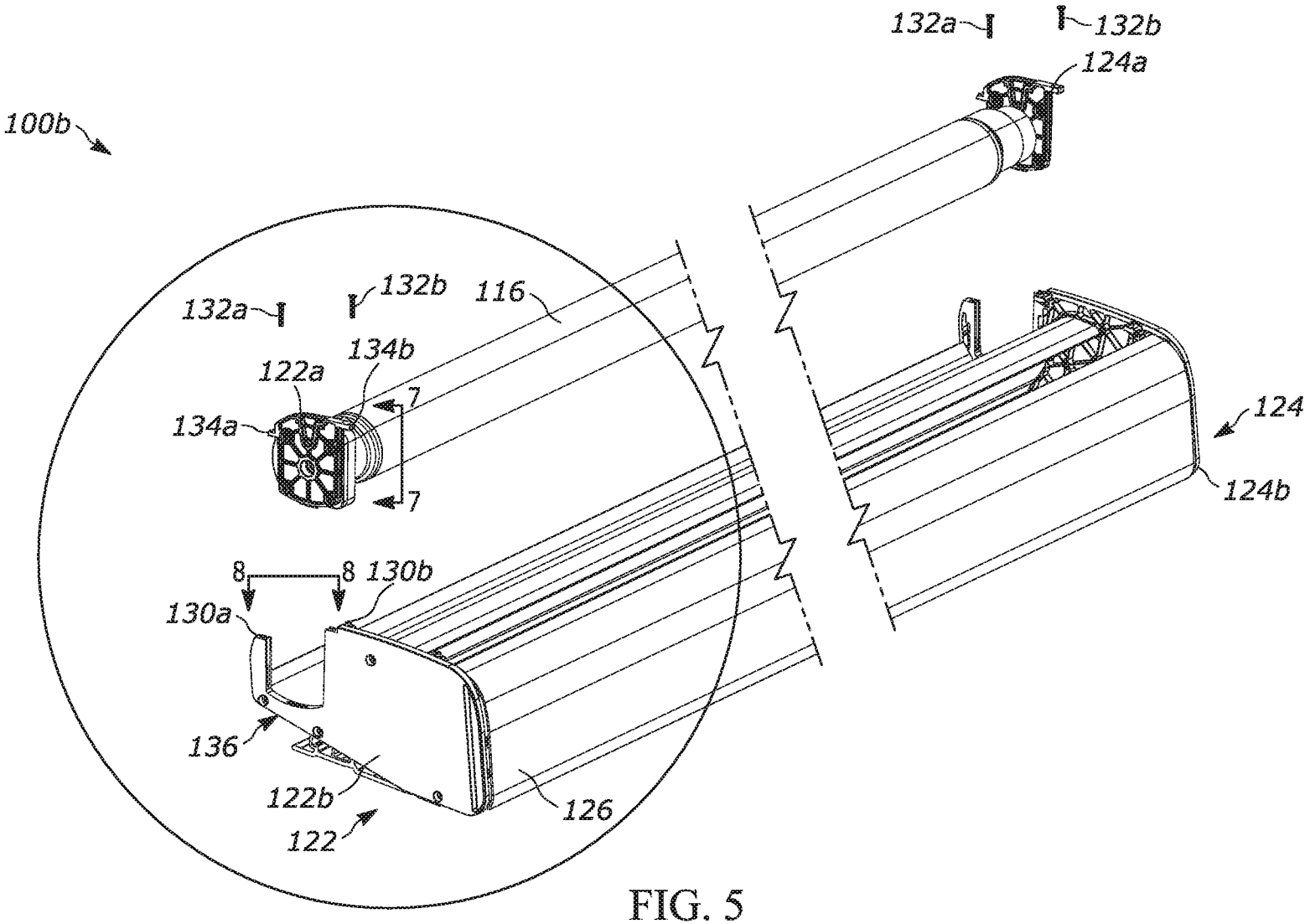
FIG. 5 is a left bottom view of a lateral arm awning assembly with a roller tube and motor mounted to a first piece of two-piece end plates, wherein the first piece, the rollbar and the motor are removed from a second piece of the two-piece end plate, in accordance with one example embodiment of the present disclosure.
Figure 6:
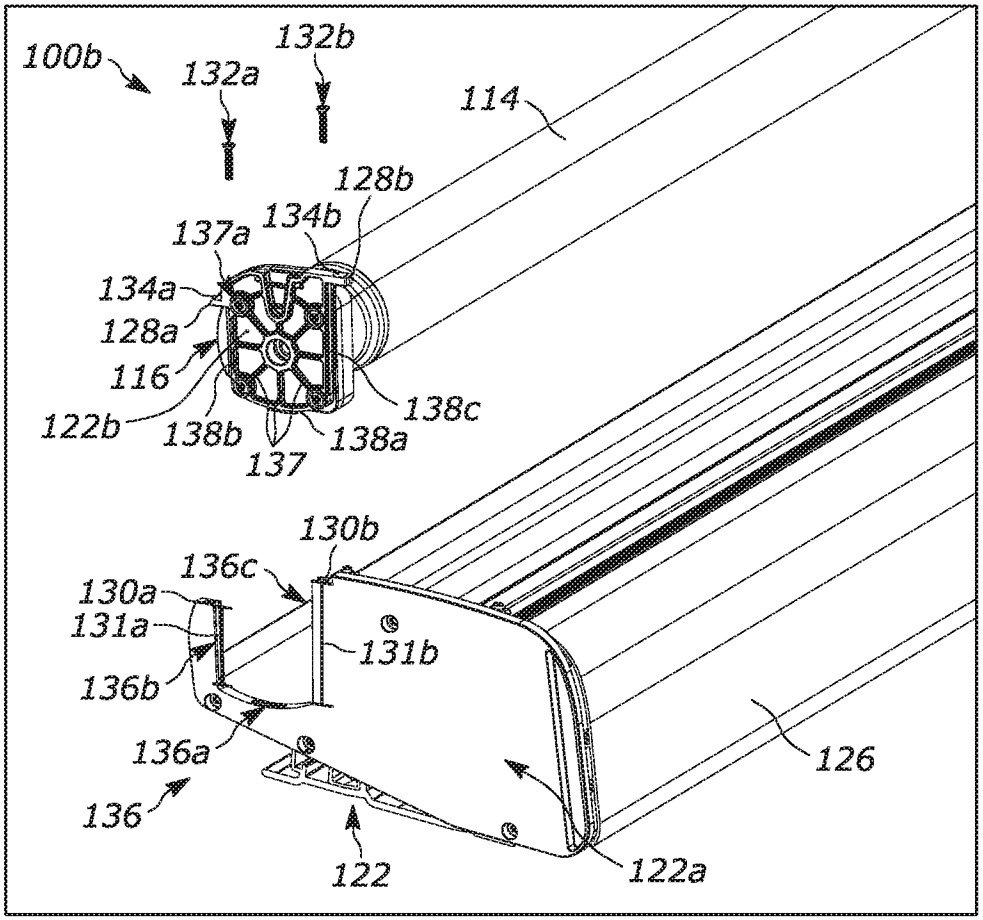
FIG. 6 is a magnified view of FIG. 5 taken in circle C.
Figure 7A:
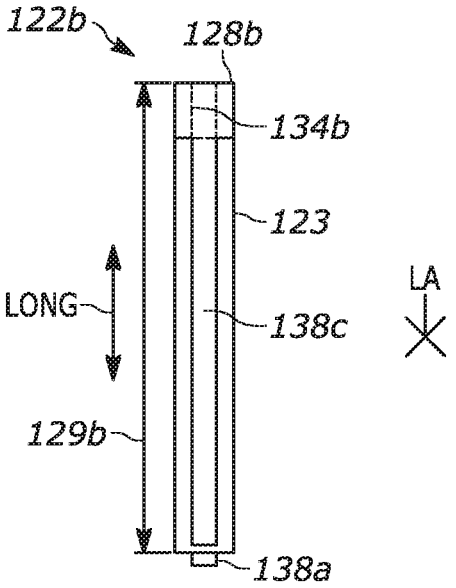
FIG. 7A is a right side elevation view of the first piece of a two-piece end plate taken along section line 7-7, in accordance with one example embodiment of the present disclosure.
Figure 7B:
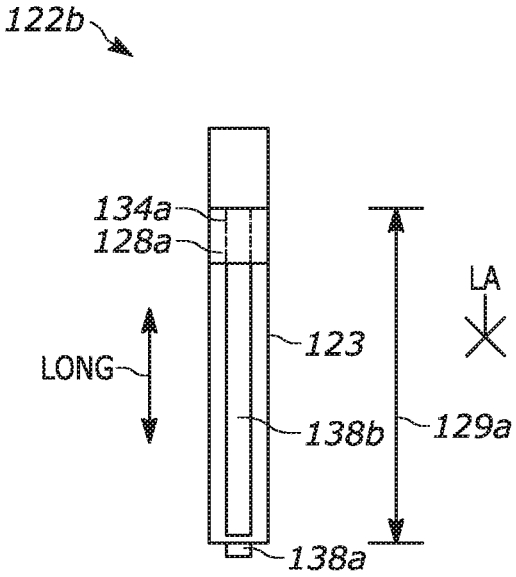
FIG. 7B is a left side elevation view of FIG. 7A.
Figure 7C:
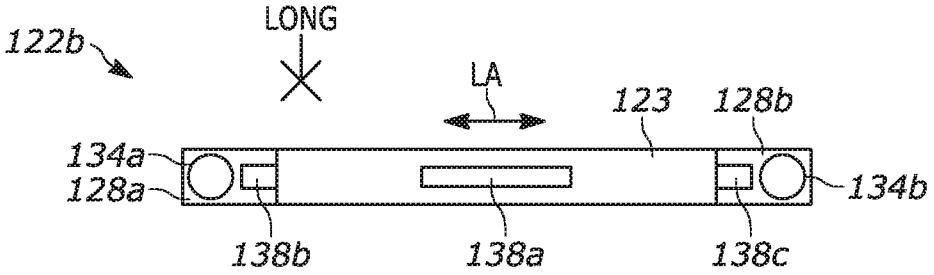
FIG. 7C is a bottom plan view of FIG. 7A.
Figure 7D:
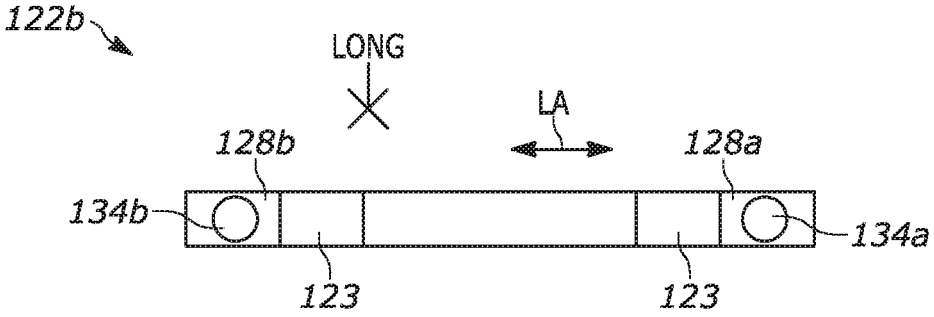
FIG. 7D is a top plan view of FIG. 7A.

As illustrated in the example embodiment of FIGS. 3-6, the first and second end caps 122, 124 comprise first end cap portions 122*a*, 124*a* and second end cap portions 122*b*, 124*b*, respectively, that are removably couplable to each other. In the illustrated example embodiment of FIGS. 3-6, the second end cap portions 122*b*, 124*b* are coupled to and/or are couplable to the awning body 126. In one example embodiment, the first and second end caps 122, 124 comprise one of metal and/or plastic. In another example embodiment, the first end cap portions 122*a*, 124*a* are made of a same or different material than the second end cap portions 122*b*, 124*b*. In yet another example embodiment, the first end cap portions 122*a*, 124*a* are formed by molding, welding, and/or cutting. In yet another example embodiment, the second end cap portions 122*b*, 124*b* are formed by molding, welding, and/or cutting. In yet another example embodiment, such as illustrated in FIG. 6, the second end cap portions 122*b*, 124*b* are formed to include one or more lateral supports 137 that provide structural strength to attachments 137*a* to the rollbar 114 and/or the motor 116.

As illustrated in the example embodiment of FIGS. 5-6, the second end cap portions 122*b*, 124*b* are complementary to a u-shaped opening 136 defined by the first end cap portions 122*a*, 124*a*. Further wherein, the second end cap portions 122*b*, 124*b* are mirror images of each other, as are the first end cap portions 122*a*, 124*a*. It would be appreciated by one having ordinary skill in the art that the opening 136 may comprise multiple shapes, and the second end cap portions would comprise a complementary shape to those openings. In one example embodiment, the second end cap portions 122*b*, 124*b* are slidably couplable to the first end cap portions 122*a*, 124*a*, respectively.

As illustrated in the example embodiments of FIGS. 7A-7D, the second end cap portion 122*b* comprises first and second laterally protruding slides 138*b*, 138*c*, a longitudinally protruding slide 138*a* and connection wings 128*a*, 128*b*. As the described and illustrated in FIGS. 7A-7D, the second end cap portion 122*b* is substantially the same as the second end cap portion 124*b*, except that the second end cap portion 124*b* is a mirror image of the first end cap portion 122*b*. In one example embodiment, the second end cap portions 122*b*, 124*b* comprise a front connection wing 128*a* and a rear connection wing 128*b*, wherein the relative height of the front and rear wings complement a shape of the u-shaped opening 136. In one example embodiment, the second end cap portions 122*b*, 124*b* comprise the front connection wing 128*a* having a first connection height 129*a* and the rear connection wing 128*b* having a second connection height 129*b*, wherein the second connection height is greater than the first connection height. In another example embodiment, the first connection height 129*a* is substantially the same as a first opening height 131*a* of the u-shaped opening 136. In yet another example embodiment, the second connection height 129*b* is substantially the same as a second opening height 131*b* of the u-shaped opening 136.

The front and rear connection wings 128*a*, 128*b* comprises through-holes 134*a*, 134*b* that are threaded, or smooth. In one example embodiment, the through-holes 134*a*, 134*b* comprises metal reinforcement. The front and rear connection wings 128*a*, 128*b* extend laterally away from a body 123 of the second end cap portion 122*b* along a lateral axis LA. In another example embodiment, the first and second laterally protruding slides 138*b*, 138*c* extend away from the body 123 along the lateral axis LA (see FIGS. 7C-7D) and the longitudinally protruding slide 138*a* extends away from the body along a longitudinal axis LONG (see FIGS. 7A-7B). In another example embodiment, the longitudinally protruding slide 138*a* extends laterally less than or equal to a side length of the body 123. The first and second laterally protruding slides 138*b*, 138*c* extend longitudinally less than or equal to a length of the body 123. In yet another example embodiment, the first protruding slide 138*b* extends longitudinally less than or equal to the second connection height 129*b* and the second laterally protruding slide 138*c* extends longitudinally less than or equal to the first connection height 129*a*.

As illustrated in the example embodiment of FIGS. 5-6, the respective second end cap portions 122*b*, 124*b* are mirror images of each other across a vertical axis VERT. The elements of the second end cap portion 122*b* described above with regard to FIGS. 7A-7D are substantially the same as the second end cap portion 124*b* except that the second end cap portion 124*b* is a mirror image of the second end cap portion 122*b*. Further, the respective first end cap portions 122*a*, 124*a* are mirror images of each other.

Figure 8:
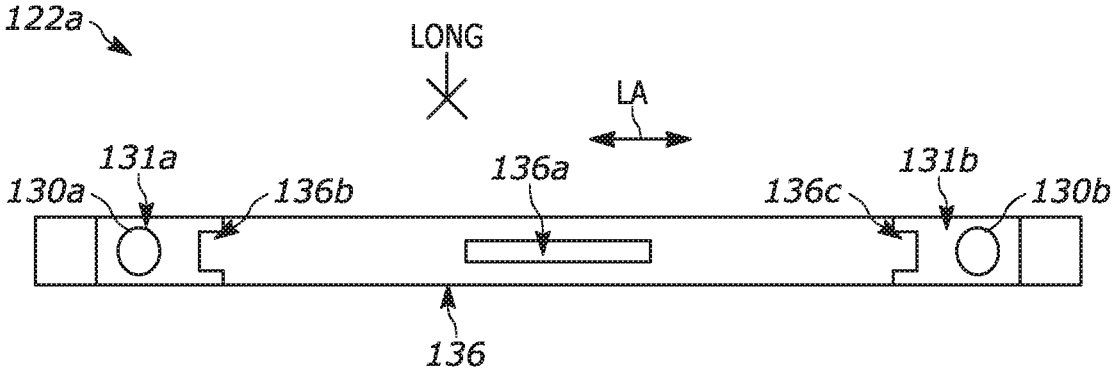
FIG. 8 is a top plan view of a second piece of a two-piece end plate taken along section line 8-8, in accordance with one example embodiment of the present disclosure.
Figure 9:
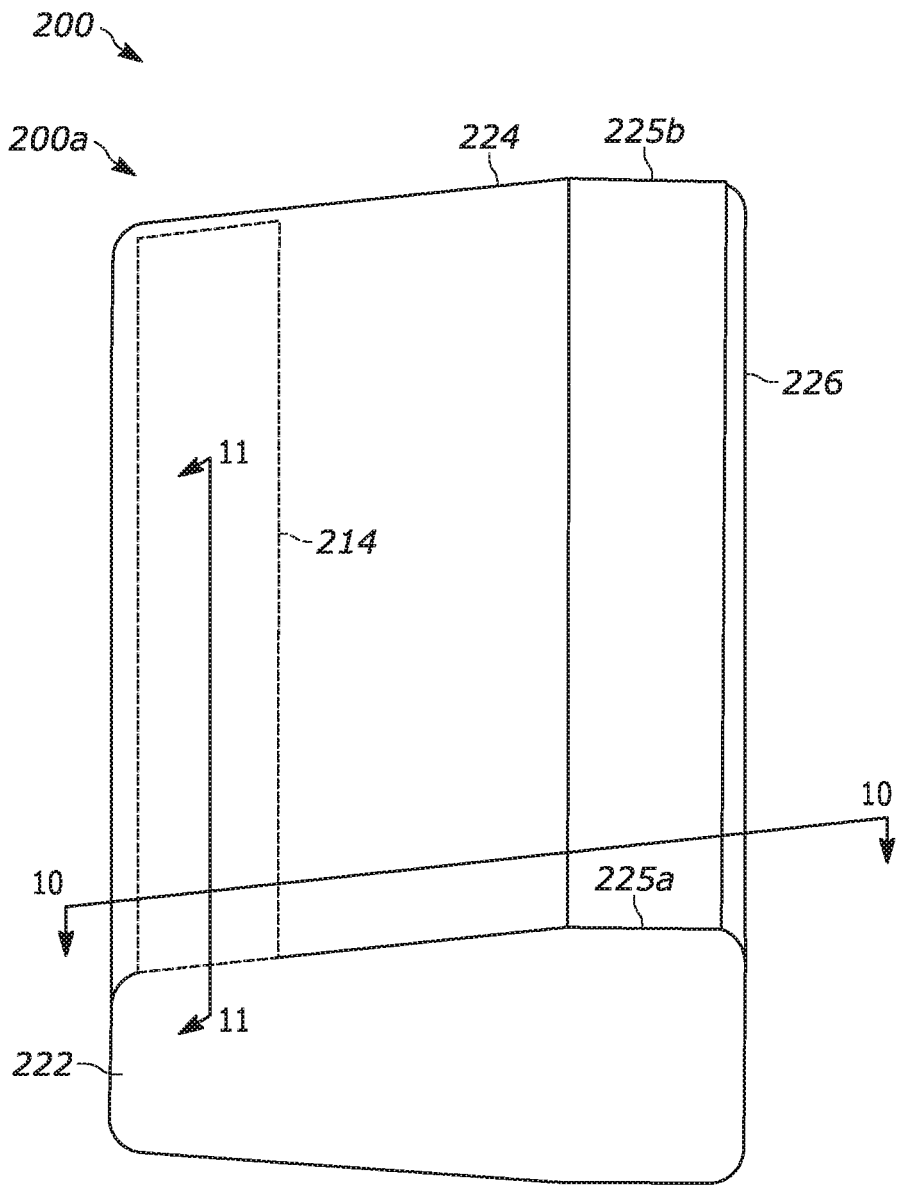
FIG. 9 is a left top view of a lateral arm awning assembly having an awning cassette or box in a retracted position with a roll bar and motor mounted to respective motor plates slidably coupled to support brackets in accordance with one example embodiment of the present disclosure.
Figure 10:
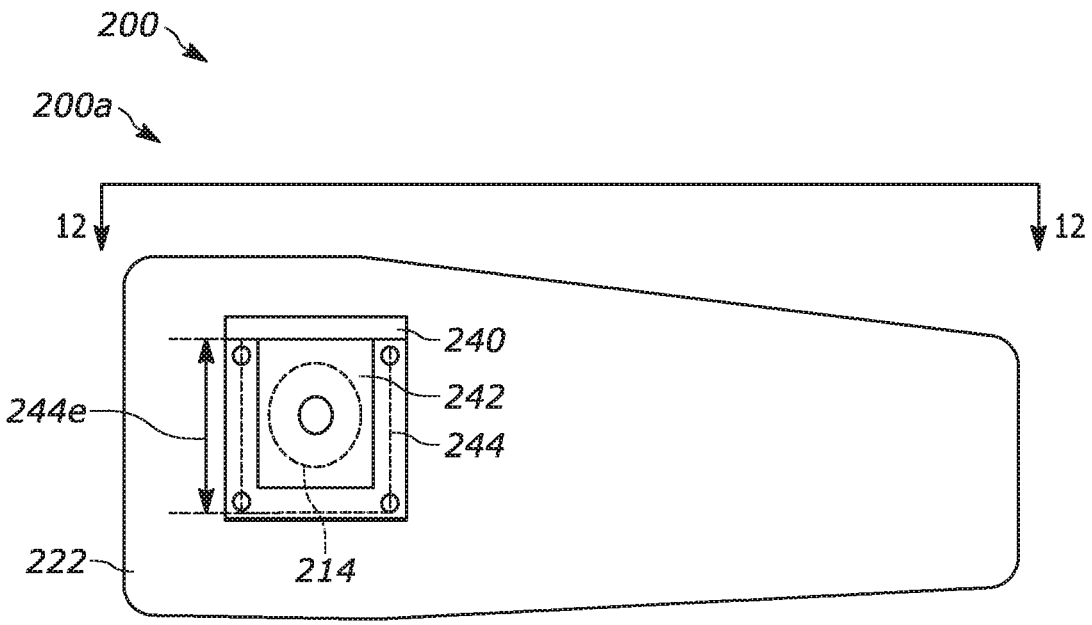
FIG. 10 is an interior left side elevation view of an end bracket taken along section line 10-10 of FIG. 9, in accordance with one example embodiment of the present disclosure.
Figure 11:
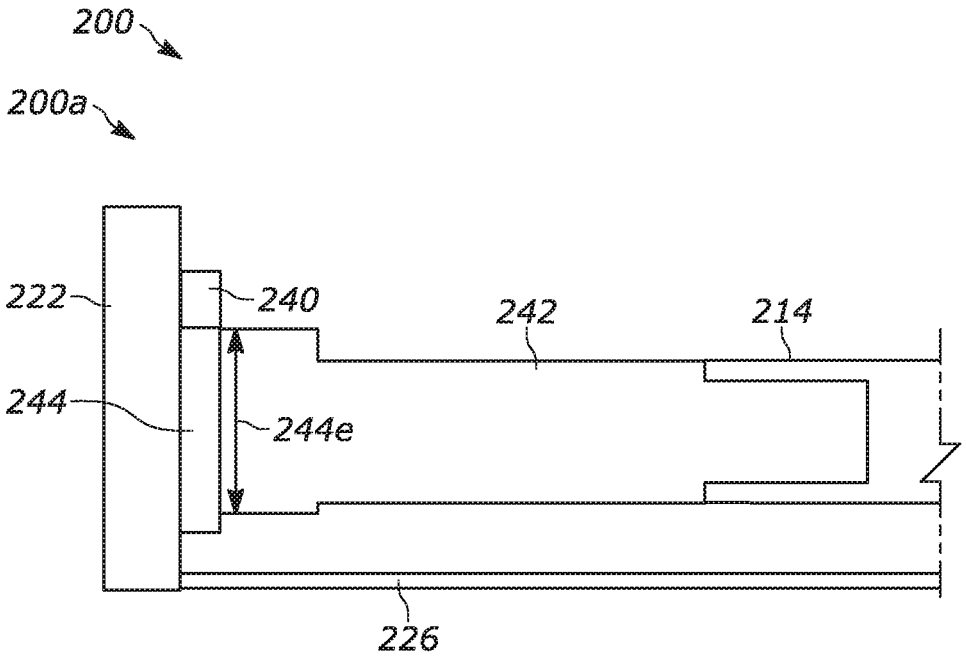
FIG. 11 is a partial elevation view of an end bracket, support bracket, motor plate, and motor taken along section line 11-11 of FIG. 9, in accordance with one example embodiment of the present disclosure.

As illustrated in the example embodiments of FIG. 8, the first end cap portion 122*a* comprise first and second laterally intruding slides 136*b*, 136*c*, a longitudinally intruding slide 136*a* and connection areas 131*a*, 131*b*. The front and rear connection areas 131*a*, 131*b* comprises through-holes 130*a*, 130*b* that are threaded, or smooth. The through-holes 130*a*, 130*b* align with the through-holes 134*a*, 134*b* of the second end cap portion 122*a* when the first end cap portion 122*a* is coupled to the second end cap portion. In one example embodiment, when the end cap 122 is assembled the front and rear connection areas 131*a*, 131*b* reside adjacent to and in contact with the front connection wing 128*a* and the rear connection wing 128*b*, respectively.

The front and rear connection areas 131*a*, 131*b* extend laterally away from each other and further define the u-shaped opening 136. In another example embodiment, the first and second laterally intruding slides 136*b*, 136*c* extend into the first end cap portion 122*a* along the lateral axis LA, wherein the first and second laterally protruding slides 138*b*, 138*c* extend away from the body 123 a substantially same distance as the first and second laterally intruding slides 136*b*, 136*c* extend into the first end cap portion 122*a*. An intruding width of the first and second laterally intruding slides 136*b*, 136*c* are substantially the same as a protruding width of the first and second laterally protruding slides 138*b*, 138*c*. In another example embodiment, the intruding width is between 1 mm to about 5 mm larger than the protruding width.

As illustrated in FIG. 8, the longitudinally intruding slide 136*a* extend into the first end cap portion 122*a* along the longitudinal axis LONG, wherein the longitudinally protruding slide 138*a* extends away from the body 123 a substantially same distance as the longitudinally intruding slide 136*a* extend into the first end cap portion 122*a*. A longitudinal intruding width of the longitudinally intruding slide 136*a* is substantially the same as a longitudinal protruding width of the longitudinally protruding slide 138*a*. In another example embodiment, the longitudinal intruding width is between 1 mm to about 5 mm larger than the longitudinal protruding width. In another example embodiment the longitudinally intruding slide 136*a* and/or first and second laterally intruding slides 136*b*, 136*c* extend less than or equal to a respective side length of the u-shaped channel 136.

The elements of the first end cap portion 122*a* described above with regard to FIG. 8 are substantially the same as the first end cap portion 124*a* except that the first end cap portion 124*b* is a mirror image of the first end cap portion 122*a*.

As illustrated in the example embodiment of FIGS. 5-6, the second end cap portion 122*b* is slidably insertable and removable from the u-shaped channel 136 of the first end cap portion 122*a*. The complementary structures of the second end cap portion 122*b* and the u-shaped channel 136 of the first end cap portion 122*a* allows for easy coupling and uncoupling of the two end cap portions. The second end cap portions 122*b*, 124*b*, being coupled to the rollbar 114 at spaced opposite ends, are slidably inserted into the u-shaped channels 136 on the first end cap portions 122*a*, 124*a*, wherein the first and second laterally protruding slides 138*b*, 138*c* enter the first and second laterally intruding slides 136*b*, 136*c*, respectively, and travel along the lateral axis until the longitudinally protruding slide 138*a* is housed within the longitudinally intruding slide 136*a* and/or the front and rear connection wings 128*a*, 128*b* are in contact with the front and rear connection areas 131*a*, 131*b*, respectively. The through-holes 130*a*, 130*b* are thus aligned with the through-holes 134*a*, 134*b* and first and second connectors 132*a*, 132*b* are inserted into through-holes 130*a*, 134*a*, and 130*b*, and 134*b*, respectively. In one example embodiment, the first and second connectors 132*a*, 132*b* are threaded (e.g., screws).

To remove the rollbar 114 and/or motor 116, the first and second connectors 132*a*, 132*b* are removed from the through-holes 130*a*, 134*a*, and 130*b*, and 134*b*, respectively. The second end cap portions 122*b*, 124*b* are slidably removed from the u-shaped channels 136 on the first end cap portions 122*a*, 124*a*, wherein the longitudinally protruding slide 138*a* is removed from within the longitudinally intruding slide 136*a* and/or the front and rear connection wings 128*a*, 128*b* are removed from the front and rear connection areas 131*a*, 131*b*, respectively. The first and second laterally protruding slides 138*b*, 138*c* are laterally removed from the first and second laterally intruding slides 136*b*, 136*c* and travel along the lateral axis until the second end cap portions 122*b*, 124*b* are removed from the u-shaped channels 136 on the first end cap portions 122*a*, 124*a*.

Another example embodiment of the awning cassette 200 is illustrated in FIGS. 9-14. Features of the awning cassette 200 illustrated in FIGS. 9-14 that are similar to the features of the awning cassette 100 illustrated in FIGS. 3A-8 will be identified by like numerals increased by a factor of one-hundred, unless stated otherwise.

As illustrated in the example embodiment of FIGS. 9-14, the first and second end caps 222, 224 are couplable to a roll bar 214 (illustrated in phantom) by a support bracket 244 coupled to the end caps 222, 224. In the illustrated example embodiment of FIGS. 10-14, the support bracket 244 comprises a u-shape backed by respective first or second end caps 222, 224 and slidably supports a motor plate 240, the motor plate defining an upper portion 241 having a front connection wing 228*a* and a rear connection wing 228*b* and a relatively more narrow lower portion 241*b* (see FIG. 13). In one example embodiment, the front and rear connection wings 228*a*, 228*b* extend laterally away from each other along the lateral axis LA.

In the illustrated example embodiment, the motor plate 240 further supports a motor 242 on at least one end, and the roll bar 214 on the other end. The motor 242 supports the roll bar 214. On one example embodiment, the motor 242 and the roll bar 214 extend away from the motor plate 240 along a vertical axis VERT. In one example embodiment, the support bracket 244 comprises one of metal and/or plastic. In another example embodiment, the support bracket 244 is made of a same or different material than the first and second end brackets 222, 224. In yet another example embodiment, the support bracket 244 is formed by molding, welding, and/or cutting. In yet another example embodiment, the support bracket 244 is coupled to the end brackets 222, 224 by bolting, welding, and/or the like.

Figure 12:
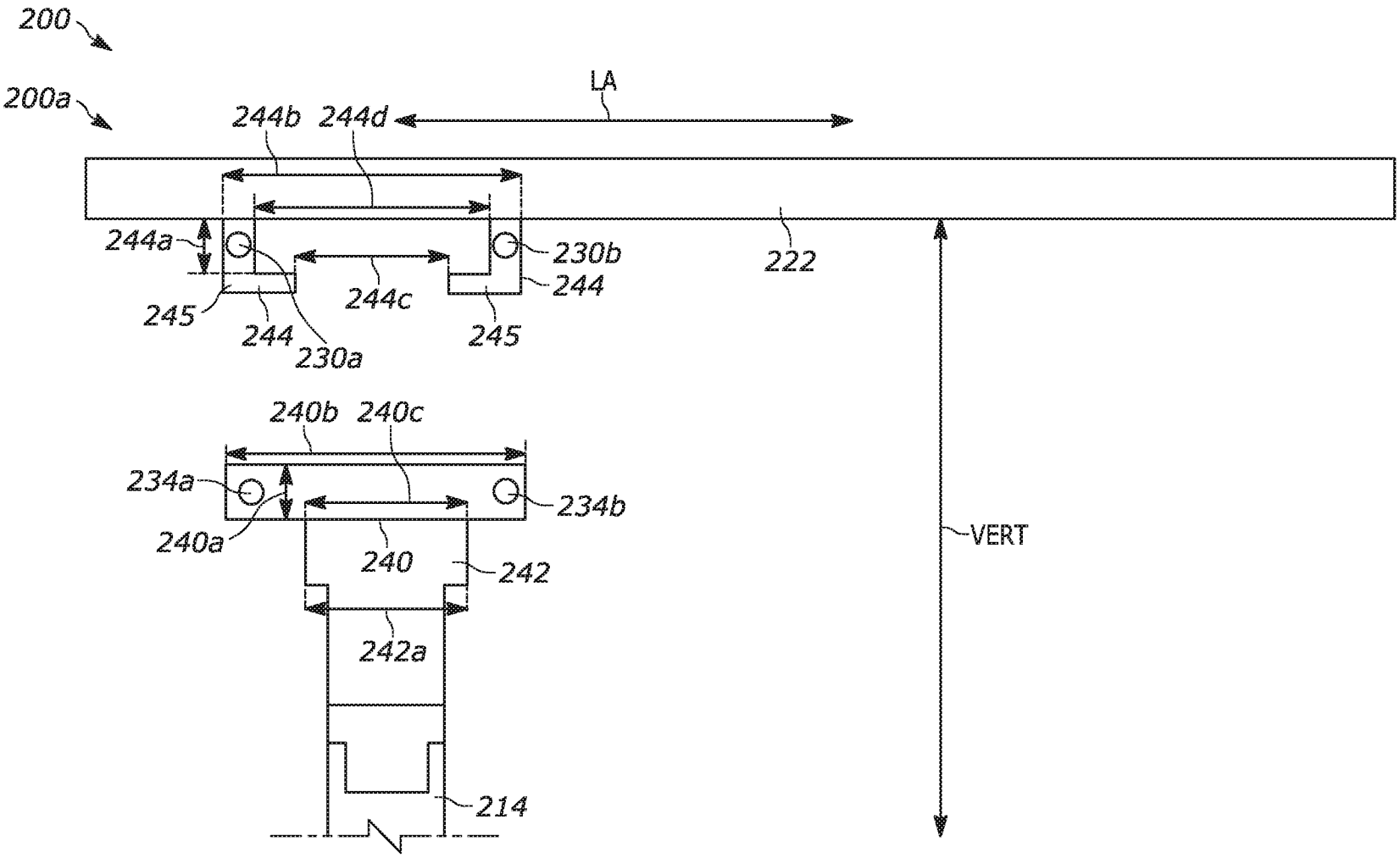
FIG. 12 is a partial plan view of an end bracket, support bracket, motor plate, and motor in a disassembled state taken along section line 12-12 of FIG. 10, in accordance with one example embodiment of the present disclosure.

As illustrated in the example embodiment of FIG. 12, the motor plate 240 is complementary to the support bracket 224. In one example embodiment, the motor plate 240 comprises one of metal and/or plastic. In another example embodiment, the motor plate 240 is made of a same or different material than the support bracket 244. In yet another example embodiment, the motor plate 240 is formed by molding, welding, and/or cutting. In yet another example embodiment, the motor plate 240 is coupled to the motor 242 by bolting, welding, and/or the like.

Figure 13:
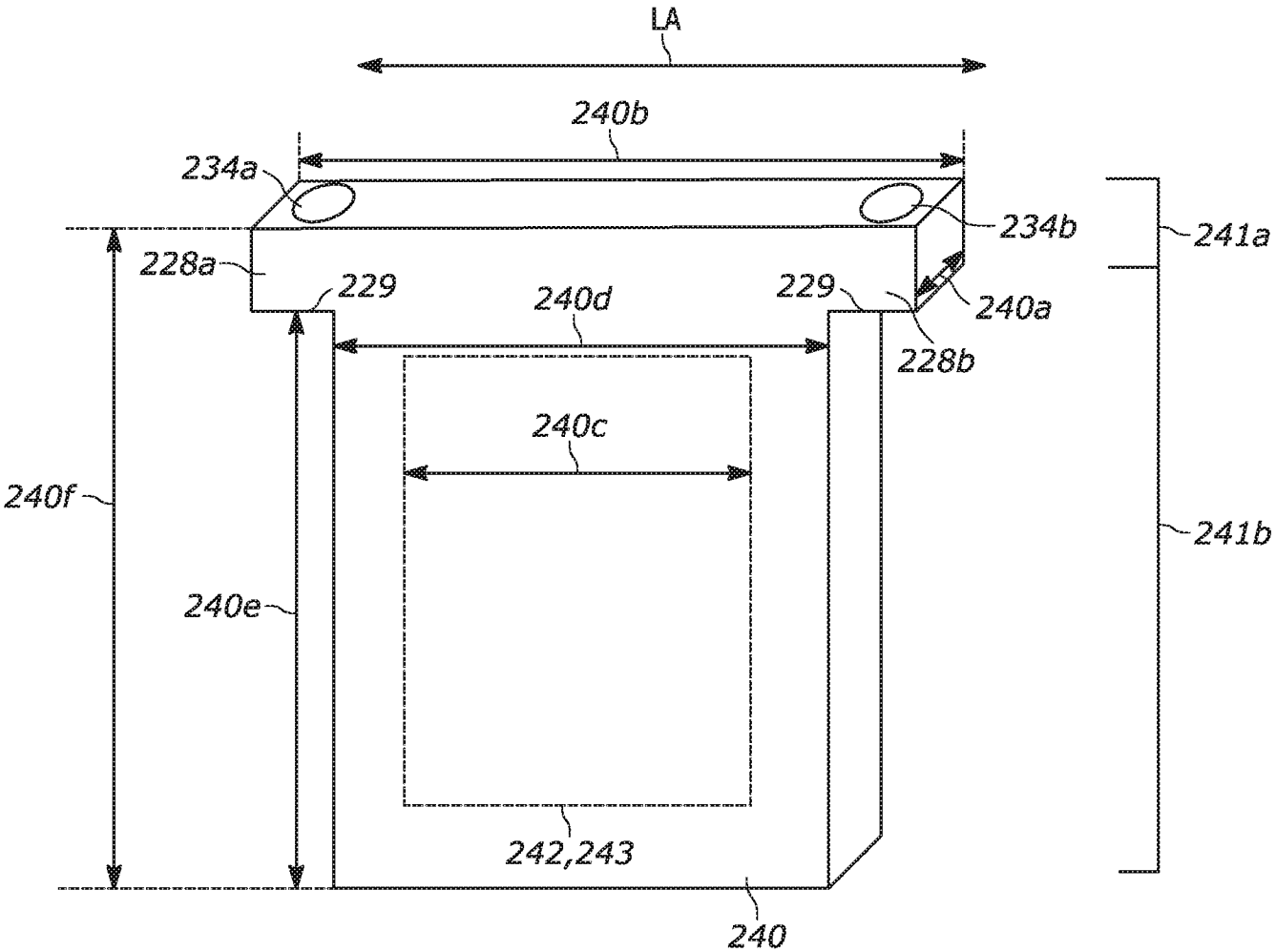
FIG. 13 is a front perspective view of motor plate in accordance with one example embodiment of the present disclosure.

Further as illustrated in the example embodiment of FIGS. 12-13, the motor plate 240 has a plate width 240*a*, an upper plate length 240*b*, a plate connection length 240*c* (illustrated at the motor 242 connection location and/or the roll bar connection location 243 shown in phantom in FIG. 13), a lower plate length 240*d*, a lower plate height 240*e*, and a total plate height 240*f*. In one example embodiment illustrated in FIGS. 10-12, the support bracket 244 has an inner bracket width 244*a*, an outer bracket length 244*b*, a bracket connection length 244*c*, an inner plate length 244*d*, and an interior bracket height 244*e*. Wherein, the plate width 240*a* is less than or equal to the inner bracket width 244*a*. In one example embodiment, the plate width 240*a* is between 1% and 10% less than the inner bracket width 244*a*. Wherein, the upper plate length 240*b* is greater than or equal to the outer bracket length 244*b*. In one example embodiment, the upper plate length 240*b* is between 0.5% and 10% greater than the outer bracket length 244*b*. Wherein, the plate connection length 240*c* is less than or equal to the bracket connection length 244*c*. In one example embodiment, the plate connection length 240*c* is between 0.5% and 10% less than the bracket connection length 244*c*. Wherein, the lower plate length 240*d* is less than or equal to the inner plate length 244*d*. In one example embodiment, the lower plate length 240*d* is between about 1% and 5% less than the inner plate length 244*d*. Wherein, the lower plate height 240*e* is less than or equal to the interior bracket height 244*e*, such that connection wings 228*a*, 228*b* come into contact with the connection bracket 244. In one example embodiment, the lower plate height 240*e* is between about 0.1% and 1% less than the interior bracket height 244*e*.

As the described and illustrated in FIGS. 10-14, the first end cap 222 is substantially the same as the second end cap 224, wherein the connection bracket 244 supported therein is also the same, except that the second end cap and the attached connection bracket is a mirror image of the first end cap and attached connection bracket. Likewise, the motor plate 240 slidably couplable to the connection bracket 244 on the first end cap 222 is a mirror image of the motor plate slidably couplable to the connection bracket on the second end cap 224, wherein the roll bar 214 spaces the mirror image motor plates from each other.

In the illustrated example embodiments of FIGS. 9-14, the lower portion 241*b* of the motor plates 240 are inserted into the support brackets 244 on both the first and second end caps 222, 224. The front and rear connection wings 228*a*, 228*b* comprise through-holes 234*a*, 234*b* that align with connection areas 230*a*, 230*b* that are defined by the support bracket 244 when the motor plate 240 is inserted into the support bracket 244. In one example embodiment, a connection wing under surface 229 is in contact with a connection bracket top surface 245 when the motor plate 240 is coupled to the support bracket 244. In one example embodiment, when the motor plate 240 is housed within the support bracket 244 the connection areas 230*a*, 230*b* are concentrically aligned with the respective through holes 234*a*, 234*b*, wherein an opening defined by the concentric alignment extends toward the box cassette. The connection areas 230*a*, 230*b* and/or through holes 234*a*, 234*b* are one of threaded, or smooth. In one example embodiment, connection areas 230*a*, 230*b* and/or through holes 234*a*, 234*b* comprises metal reinforcement.

Figure 14:
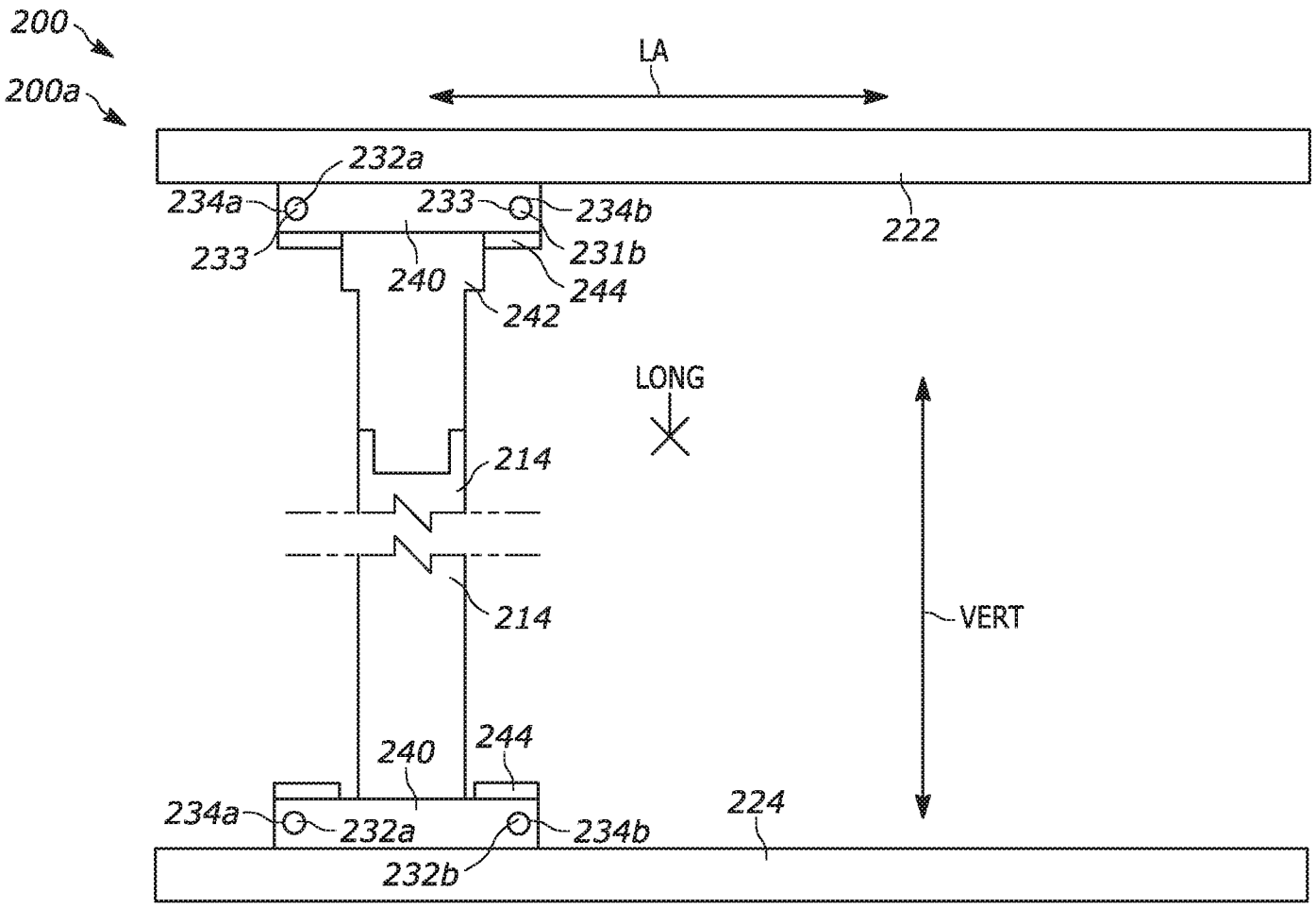
FIG. 14 is a plan view of an end bracket, support bracket, motor plate, motor and interrupted roll bar in an assembled state taken along section line 12-12 of FIG. 10, in accordance with one example embodiment of the present disclosure.

As illustrated in FIG. 14 wherein the awning body 226 is removed for clarity, first and second connectors 232*a*, 232*b* (e.g., a screw, bolt, etc.) are utilized to couple the motor plate 240 to the connection bracket 244. In this example embodiment, the motor 242 is on a single side of the roll bar 214. It would be understood by one having ordinary skill in the art that the roll bar 214 is attached on one side to the motor plate 240 and on another side is coupled to the motor 242 on another side. In this example embodiment, to remove the roll bar 214 and the motor 242, the first and second connectors 232*a*, 232*b* are removed in a longitudinal direction LONG that comports to out of the page of FIG. 14. Interactive surfaces 233 of the connectors 232*a*, 232*b* reside on a plane corresponding to the lateral axis, such that the interactive surfaces are one of transverse or parallel to the lateral axis providing ease of reach to attach or remove the connectors. Once the first and second connectors 232*a*, 232*b* are uncoupled from the motor plates 240 and the support brackets 244 (e.g., wherein one support bracket is coupled to the first end bracket 222 and the other support bracket is coupled to the second end bracket 224), the roll bar 214, being coupled to the motor 242 and the motor plates 240 are moved in the longitudinal direction until the motor plates are free from connection with the support brackets.

Advantageously, the rollbar 114, 224, and/or the motor 116, 242 are easily removable without having to take down the entire awning cassette 100, 200. In one example embodiment, the location of the first and second connectors 132*a*, 132*b* along with the two-piece end bracket 122 allows for access and easy removal and attachment of the rollbar 114 and/or motor 116. The presence of the intruding slides 136 and complementary protruding slides 138 allow for support of the rollbar 114 and sliding attachment and detachment. Further, a single user can remove or attach both the second end bracket portion 122*b*, 124*b* to the first end bracket portions 122*a*, 124*a* by either lifting the rollbar 114, or simultaneously inserting the first end bracket portions into the second end bracket portions. In another example embodiment, the location of the first and second connectors 232*a*, 232*b* along with common removal direction (e.g, the outward/longitudinal direction) of the motor plate 240 allows for access and easy removal and attachment of the rollbar 214 and/or motor 224. The presence of the support bracket 244 and the complementary motor plate 240 allow for support of the rollbar 214 and sliding attachment and detachment. Additionally, in this example embodiment, the single user can remove or attach both the motor plates 240 to the support brackets 244 coupled respectively to the first and second end brackets 222, 224 by lifting the rollbar 214, or simultaneously inserting the motor plate 240 into the respective support brackets.

Although various embodiments of this invention have been described above with a certain degree of particularity, or with reference to one or more individual embodiments, those skilled in the art could make numerous alterations to the disclosed embodiments without departing from the spirit or scope of this invention. All directional references (e.g., proximal, distal, upper, lower, upward, downward, left, right, lateral, front, back, top, bottom, above, below, vertical, horizontal, clockwise, and counterclockwise) are only used for identification purposes to aid the reader's understanding of the present invention, and do not create limitations, particularly as to the position, orientation, or use of the invention. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the basic elements of the invention as defined in the following claims.

The awning assembly 2 illustrated in the figures and described in the above example embodiments advantageously eliminates typical construction elements that significantly contribute to higher cost. For example, by positioning the drive motor 84 on the roller tube 6 at the distal end of the awning arms 12, 14, the lead rail of conventional awning assemblies is eliminated. As well, conventional aluminum housing or boxes that support the canopy along the structural or sidewall of the house or motor home can also be eliminated. Since the canopy 4 is retracted from the roll tube 6 as it moves away from the sidewall, only a modest extrusion is needed by way of the canopy rail 8 and its rail tube 24 that allows the canopy 4 to be conveniently slipped into location during its initial assembly. Thus, this compact awning assembly 2 design eliminates bulky housings, large support structures of conventional awning systems found on the sidewalls, and their associated cost.

In the foregoing specification, specific embodiments have been described. However, one of ordinary skill in the art appreciates that various modifications and changes can be made without departing from the scope of the disclosure as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. In one non-limiting embodiment the terms are defined to be within for example 10%, in another possible embodiment within 5%, in another possible embodiment within 1%, and in another possible embodiment within 0.5%. The term "coupled" as used herein is defined as connected or in contact either temporarily or permanently, although not necessarily directly and not necessarily mechanically. A device or structure that is "configured" in a certain way is configured in at least that way, but may also be configured in ways that are not listed.

To the extent that the materials for any of the foregoing embodiments or components thereof are not specified, it is to be appreciated that suitable materials would be known by one of ordinary skill in the art for the intended purposes.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

What is claimed is:

1. A lateral arm awning assembly comprising:

a box cassette supporting a roll bar;

a first end cap comprising an outer surface of the box cassette, the first end cap formed by a first end cap portion and a second end cap portion, the first end cap portion coupled to a first box end of the box cassette and the second end cap portion coupled to a first bar end of the roll bar, the second end cap portion removably couplable to the first end cap portion via first and second protruding slides of the second end cap portion being enveloped by first and second intruding slides defined by the first endcap portion, said first and second protruding slides extending along a lateral axis; and a second end cap coupled to a second box end of the box cassette, the first box end opposite the second box end, the second end cap spaced from the first end cap by the box cassette, the second end cap having a third end cap portion and a fourth end cap portion, the third end cap portion coupled to the second box end and the fourth end cap portion coupled to a second bar end of the roll bar, the first bar end opposite the second bar end, the fourth end cap portion removably couplable to the third end cap portion; wherein the second end cap portion includes first and second connection wings extending along the lateral axis, the first and second connection wings defining first and second through-holes which extend along respective longitudinal axes and align with first and second connection areas on the first end cap.

2. The lateral arm awning assembly of claim 1 wherein a drive motor is coupled to the roll bar.

3. The lateral arm awning assembly of claim 1 wherein the first end cap comprises a mirror image of the second end cap.

4. The lateral arm awning assembly of claim 1, wherein the second and fourth end cap portions are complementary to a u-shaped opening defined by the first and third end cap portions.

5. The lateral arm awning assembly of claim 1, the second end cap portion comprising the first and second laterally protruding slides and a longitudinally protruding slide.

6. The lateral arm awning assembly of claim 5, the first end cap portion defining a u-shaped opening, the u-shaped opening comprising the first and second laterally intruding slides that are complementary to the first and second laterally protruding slides, a longitudinally intruding slide that is complementary to the longitudinally protruding side and the first and second connection areas that are complementary to the first and second connection wings.

7. The lateral arm awning assembly of claim 1, wherein when the second and fourth end cap portions reside within a u-shaped opening defined by the first and third end cap portions, the first end cap portion and the second end cap portion comprise the first end cap, and the third end cap portion and the fourth end cap portion comprise the second end cap.

8. The lateral arm awning assembly of claim 1, wherein the first and second end caps extend along respective lateral axes and are spaced from each other by the roll bar that extends along a vertical axis.

9. The lateral arm awning assembly of claim 8, further wherein first and second connection wings of the fourth end cap portion extend along a second lateral axis, the first and second connection wings of the fourth end cap portion defining first and second through holes which extend along respective longitudinal axes and align with first and second connection areas of the third end cap portion when the fourth end cap portion resides within a u-shaped opening defined by the third end cap portion.

10. The lateral arm awning assembly of claim 9, wherein the first and third end cap portions are mirror images of each other and the second and fourth end cap portions are mirror images of each other.

11. The lateral arm awning assembly of claim 9, comprising connectors residing within the first and second through holes and the first and second connection areas along respective longitudinal axes, wherein connector heads of the connectors reside on a surface transverse to the respective longitudinal axes of the connectors.

12. The lateral arm awning assembly of claim 1, wherein the second and fourth end cap portions comprise first and second support brackets that are supported by the first and third end cap portions.

13. The lateral arm awning assembly of claim 12, wherein the first and second support brackets in conjunction with the first and third end cap portions define respective u-shaped support structures.

14. The lateral arm awning assembly of claim 13, wherein a drive motor is coupled to the roll bar, and the roll bar is coupled to a first motor plate by the drive motor on a first bar end and the roll bar is coupled to a second motor plate on the second bar end.

15. The lateral arm awning assembly of claim 14, wherein the first motor plate is complementary to the first support bracket and the second motor plate is complementary to the second support bracket wherein the first support bracket supports and is slidably coupled to the first motor plate when the first motor plate is housed within the first support bracket and the second support bracket supports and is slidably coupled to the second motor plate when the second motor plate is housed within the second support bracket.

16. The lateral arm awning assembly of claim 14, wherein the first and second end caps extend along respective lateral axes and are spaced from each other by the roll bar that extends along a vertical axis, and wherein first and second connection wings of the motor plate extend along the lateral axis, the first and second connection wings of the motor plate defining first and second through holes which align with first and second connection areas of the first support bracket when the first motor plate resides within the u-shaped support structure defined by the first support bracket.

17. The lateral arm awning assembly of claim 16, comprising connectors residing within the first and second through holes and the first and second connection areas along respective longitudinal axes, wherein connector heads of the connectors reside on a surface transverse to the longitudinal axis.

18. The lateral arm awning assembly of claim 17, wherein the first and second support brackets are mirror images of each other and the first and second motor plates are mirror images of each other.

19. A lateral arm awning assembly comprising:

a roll bar coupled to a motor;

a box cassette supporting the roll bar;

a first end cap defining an outer surface of the box cassette, the first end cap having a first end cap portion and a second end cap portion that together form the outer surface of the box cassette, the first end cap portion coupled to a first box end of the box cassette and the second end cap portion coupled to a first bar end of the roll bar, the second end cap portion removably couplable to the first end cap portion, the first end cap portion defining a u-shaped channel complementary to the second end cap portion and first and second connection areas, the u-shaped channel defining an open end and a closed end, the second end cap portion slidably connectable to the first end cap portion via the open end, the second end cap portion having first and second laterally protruding slides extending along a lateral axis, a longitudinally protruding slide, and first and second connection wings extending along the lateral axis and respectively defining first and second through holes extending along respective longitudinal axes, the first and second through holes being concentrically aligned with the first and second connection areas, the first and second through holes and the first and second connection areas defining an opening that extends towards the box cassette.

20. A lateral arm awning assembly comprising:

a roll bar coupled to a motor;

a box cassette supporting the roll bar;

a first end cap comprising an outer surface of the box cassette, the first end cap having a first end cap portion and a second end cap portion, the first end cap portion coupled to a first box end of the box cassette and the second end cap portion coupled to a first bar end of the roll bar, the second end cap portion removably couplable to the first end cap portion, the first end cap portion defining a u-shaped channel complementary to the second end cap portion and first and second connection areas, the u-shaped channel comprising a u-shaped void in the outer surface of the box cassette, the second end cap portion having first and second connection wings extending along a lateral axis and respectively defining first and second through holes extending along respective longitudinal axes, the first and second through holes being concentrically aligned with the first and second connection areas, the first and second through holes and the first and second connection areas defining an opening that extends towards the box cassette; and a second end cap coupled to a second box end of the box cassette, the first box end opposite the second box end, the second end cap spaced from the first end cap by the box cassette, the second end cap having a third end cap portion and a fourth end cap portion, the third end cap portion coupled to the second box end and the fourth end cap portion coupled to a second bar end of the roll bar, the first bar end opposite the second bar end, the fourth end cap portion removably couplable to the third end cap portion wherein the first end cap comprises a mirror image of the second end cap, wherein the second end cap portion comprises first and second laterally protruding slides extending along the lateral axis, and a longitudinally protruding slide, the u-shaped opening defined by the first end cap portion comprising first and second laterally intruding slides that are complementary to the first and second laterally protruding slides, and a longitudinally intruding slide that is complementary to the longitudinally protruding slide.

* * * * *